US007431184B2

(12) United States Patent
Gregory

(10) Patent No.: US 7,431,184 B2
(45) Date of Patent: Oct. 7, 2008

(54) BACKPACK HAVING DISTRIBUTED-LOAD SHOULDER STRAP SYSTEM

(75) Inventor: Wayne B. Gregory, Fallbrook, CA (US)

(73) Assignee: Bianchi International, Temecula, CA (US)

( * ) Notice: Subject to any disclaimer, the term of this patent is extended or adjusted under 35 U.S.C. 154(b) by 165 days.

(21) Appl. No.: 11/150,452

(22) Filed: Jun. 10, 2005

(65) Prior Publication Data

US 2006/0289586 A1 Dec. 28, 2006

(51) Int. Cl.
*A45F 3/04* (2006.01)

(52) U.S. Cl. ..... 224/627

(58) Field of Classification Search ..... 224/627, 224/628, 643

See application file for complete search history.

(56) References Cited

U.S. PATENT DOCUMENTS 3,174,664 A 3/1965 Hue
3,442,427 A 5/1969 Arnell et al.
3,797,718 A 3/1974 Plant
4,099,657 A 7/1978 Zufich
4,189,076 A 2/1980 Zufich
5,064,108 A 11/1991 Headley
5,090,604 A 2/1992 Howe
5,114,059 A 5/1992 Thatcher
5,181,638 A * 1/1993 McHale ..... 224/637
5,429,298 A 7/1995 Frano
5,431,317 A * 7/1995 Kliot ..... 224/153
5,449,102 A 9/1995 Sason
5,451,121 A 9/1995 Seligman
5,558,259 A * 9/1996 Izzo ..... 224/627
5,564,612 A 10/1996 Gregory
5,617,984 A * 4/1997 Fabel ..... 224/641
5,660,312 A * 8/1997 Suzuki ..... 224/627
5,725,139 A 3/1998 Smith
5,742,988 A 4/1998 Swetish
5,860,769 A * 1/1999 Seligman ..... 405/186
5,902,073 A 5/1999 Eungard et al.
5,954,250 A 9/1999 Hall et al.
5,954,253 A 9/1999 Swetish
6,015,076 A 1/2000 Pennington
6,024,265 A 2/2000 Clements
6,164,509 A * 12/2000 Gausling et al. ..... 224/627
6,179,187 B1 1/2001 Lemire et al.
6,607,108 B2 8/2003 Mydans
6,634,533 B2 10/2003 Thompson et al.
6,793,112 B2 * 9/2004 Ammerman ..... 224/607
2002/0108982 A1 8/2002 Mydans
2002/0145028 A1 10/2002 Moore
2002/0148871 A1 * 10/2002 Nakano et al. ..... 224/576
2003/0034372 A1 2/2003 Thompson et al.
2003/0121945 A1 7/2003 Lemanski, II
2004/0065704 A1 4/2004 Penny et al.
2004/0077983 A1 4/2004 Reinecke et al.

* cited by examiner

*Primary Examiner*—Nathan J Newhouse
*Assistant Examiner*—Margaret Olson
(74) *Attorney, Agent, or Firm*—David E. Heisey; Sheppard Mullin Richter & Hampton LLP

(57) ABSTRACT

A backpack is provided, having a pack body and a shoulder strap system configured to hold the pack body securely against the user even during periods of high activity. The strap system includes two shoulder straps each having a lower portion attached to a coupler having an extended interface with the pack body, to inhibit sagging and secure the pack body to the user.

10 Claims, 6 Drawing Sheets

BACKPACK HAVING DISTRIBUTED-LOAD SHOULDER STRAP SYSTEM

BACKGROUND OF THE INVENTION

The present invention relates generally to backpacks and, more particularly, shoulder strap configurations for backpacks.

Backpacks have long been used for carrying heavy, bulky loads. Over the years, backpacks of various configurations have been made, including packs having external frames, internal frames, and those without frames. External-frame backpacks typically include interconnected metal bars, forming a relatively rigid structure. A pack body, typically of nylon or canvas, is secured generally within the confines of the frame and, as such, is relatively spaced apart from the back of the user. Internal-frame backpacks typically include internal stays disposed within pockets of the body of the backpack, allowing the backpack to be positioned more closely to the back of the user. Frameless backpacks typically exclude rigid support structures, allowing the pack to conform to the user.

Regardless of type of backpack, much effort has been made to distribute the weight of the load onto the user. The ability to carry heavy loads in relative comfort depends in great part upon the placement and transfer of the load, particularly about the shoulders, hips and lumbar area of the user. As such, backpack almost universally include a pair of shoulder straps and often further include a hip belt. The shoulder straps typically are attached at fixed upper and lower locations on the pack such that the straps extend over the shoulders and under the arms, when worn. The lower end of each strap typically includes a webbing strip attached to at a prescribed point on a corresponding side of the pack. The hip belt is attached to a lower portion of the backpack and extends about the hips of the user.

Although current backpacks are generally effective at load distribution, certain shortfalls exist. For example, it is desirable to have the load of the backpack move smoothly along with the user, particularly during periods of high activity, such as running, hiking, and mountain climbing. However, many backpacks will tend to sag or otherwise mover away from the back of the user. Often, the backpack will tend to sag between the upper and lower attachment points of the shoulder straps. Such sagging can cause the pack to shift excessively, as the user moves. This can be particularly pronounced with frameless backpacks. Such shifting can cause the user to become unbalanced, especially during periods of high activity, such as running, climbing, and skiing, for example. Moreover, current designs can cause the load of the pack to be unduly concentrated on the user, particularly during high activity, which can cause discomfort, fatigue, and even injury.

It should, therefore, be appreciated that there remains a need for a backpack having shoulder straps configured to hold the load securely against the back even during high activity. The present invention fulfills this and other needs.

SUMMARY OF THE INVENTION

Briefly, and in general terms, the present invention resides in a backpack having a pack body and a shoulder strap system configured to hold the pack body securely against the user even during periods of high activity. The strap system includes two shoulder straps each having a lower portion attached to a coupler having an extended interface with the pack body, to inhibit sagging and secure the pack body to the user.

More specifically, by way of example and not limitation, the couplers have an extended interface with the pack body generally aligned with the lumbar region of the user, distributing the load along an extended portion of the pack body to inhibit the pack from sagging, keeping the pack snug on the back. Each shoulder strap is attached to a corresponding coupler, to facilitate load transfer about the lumbar and hips. More particularly, the strap system can further include two fixing straps, each connecting an intermediate portion of the shoulder strap to the corresponding coupler disposed on the side of the pack. The shoulder straps can further include quick-release latches disposed in along the strap to facilitate easy removal of the pack.

In an exemplary embodiment, the backpack includes two panels extending from opposing sides of the backpack. The panel can be attached by various approaches, such as, snaps, stitching, webbing, and lacing. The panel can also be formed integral with the portion of the pack body. Panel can also be made of various materials types having sufficient structural integrity to endure the anticipated loads, e.g., plastics to include injection-molded, fabrics, composites, and metals.

Each shoulder strap includes a padded portion having a D-ring attached to a bottom end thereof. The strap system further includes two fixing straps connecting the padded portion and to a corresponding panel extending from a side of the pack body.

In a detailed aspect of an exemplary embodiment, the fixing strap extends between a lower end of the shoulder strap and the panel. The panel includes a first edge attached along its length to the pack body and a second edge. When worn, the panel extends along the side of the user, generally about the lumbar region. The panel can further include a stiffener enclosed therein to aid in effective load transfer. The fixing strap is attached to spaced locations on the panel and loops through a D-ring on the padded portion of the shoulder strap. The fixing strap is allowed slide about the D-ring.

In another exemplary embodiment, the backpack includes a fixing strap for each shoulder strap having both ends affixed to a corresponding panel. The ends of the fixing strap are attached to upper and lower portions of the panel, respectively. A lower portion of the shoulder strap is slidably attached to the fixing strap, providing a degree of self-adjustment to further facilitate comfort and load transfer.

In yet another exemplary embodiment, couplers of the backpack can be configured as a pair of stiffening wands secured along corresponding side portions of a pack body, each having a lower strap portion attached thereto, connecting the stiffening wand to an intermediate portion of the corresponding shoulder strap.

Embodiments in accordance with the present invention can include, among others, backpacks having external frames, internal frames, and frameless.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
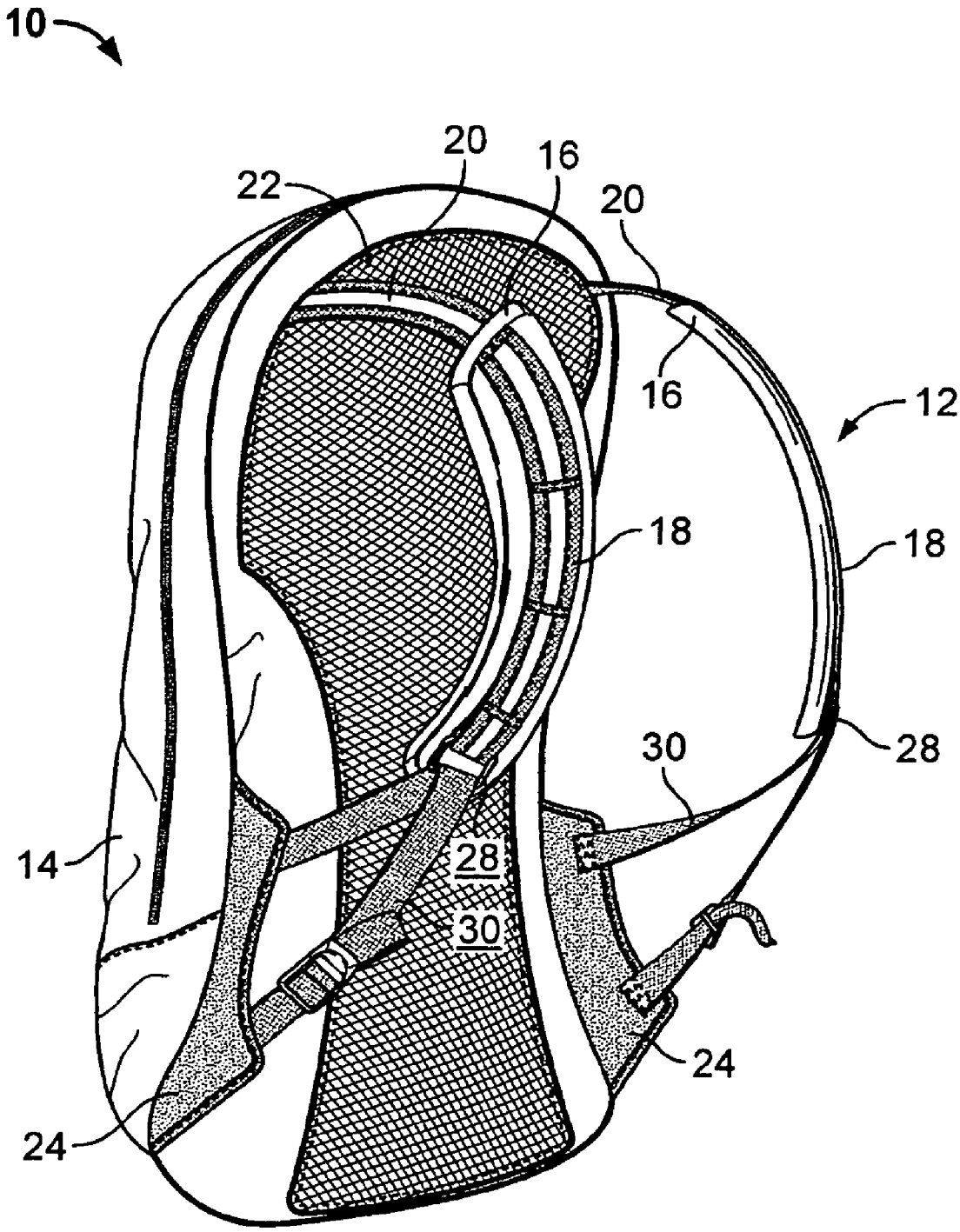
FIG. 1 is a perspective view of a backpack in accordance with the invention, depicting a pair of shoulder straps, each attached to a panel extending from respective sides of the pack body.

With reference to the illustrative drawings, and particularly to FIG. 1, there is shown a frameless backpack 10 having a shoulder strap system 12 configured to hold a pack body 14 securely against the user (not shown). The strap system includes two shoulder straps 16 each having an upper end 20 extending to an upper portion 22 of the pack The system includes two couplers, panels 24, extending from opposing sides of the backpack. Each shoulder strap includes a padded portion 18 in an intermediate region of the strap and a D-ring 28 for securing to the panel. The strap system further includes two fixing straps 30 connecting the padded portion and the corresponding panel. As described in detail below, each shoulder strap provides an extended interface with the pack body, to inhibit sagging. Moreover, the backpack can be secured snuggly around the torso of the user, even during periods of high activity.

Figure 2:
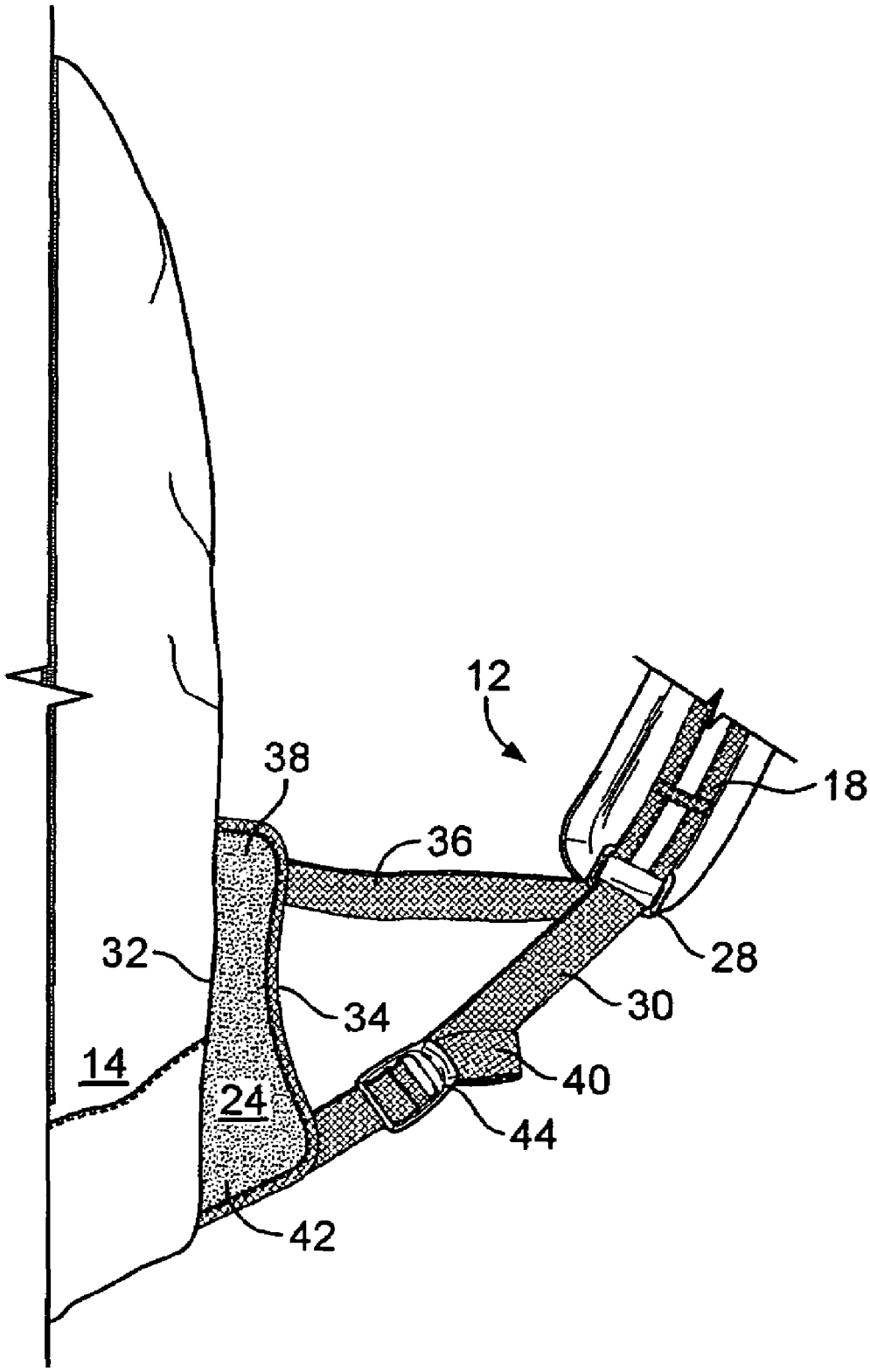
FIG. 2 is an elevational view of a side portion of the backpack of FIG. 1, depicting the attachment configuration for the lower portion of a shoulder strap.

With reference now to FIG. 2, each panel 24 includes a first edge 32 attached along its length to the pack body 14 and an opposing second edge 34. The panel can further include a stiffener enclosed within a fabric covering. When worn, the panel extends along the side of the user, generally about the lumbar region. In the exemplary embodiment, the panel is form of plastic; however, various other materials can be used, as desired.

The fixing strap 30 has a first end 36 fixed to an upper portion 38 of the second edge 34 and a second end 40 fixed to a lower portion 42 of the second edge. The fixing strap loops through the D-ring 28 on the padded portion of the shoulder strap 12. A ladder lock 44 is attached to the lower portion of the panel, and the second end of the fixing strap is secured through the ladder lock, thereby securing the padded portion to the panel. The fixing strap is allowed to slide about the D-ring, enabling the shoulder strap system to accommodate the user's body even during high activity.

In the exemplary embodiment, the panel is sewn in place to the pack body; however, various other approaches for securing can be used, such as, snaps, webbing, and lacing. The panel can also be formed integral with the portion of the pack body and can be made of various materials types having sufficient structural integrity to endure the anticipated loads, e.g., plastics, composites, fabrics, and metals.

In the exemplary embodiment, a frameless backpack is depicted; however, various other backpack structures can be used, including external and internal frames, among others. In frameless backpacks, the enhanced load transfer and support in the lumbar region, further inhibit the pack body from folding about its back panel, thereby stabilizing the pack and facilitating a clean wrap about lumbar area even without need of a hip belt. Moreover, hip belts can be used and can be configured with need of additional stabilizer straps integrated into the belt. The shoulder straps can further include quick-release latches disposed in along the strap to facilitate easy removal of the pack.

Figure 3:
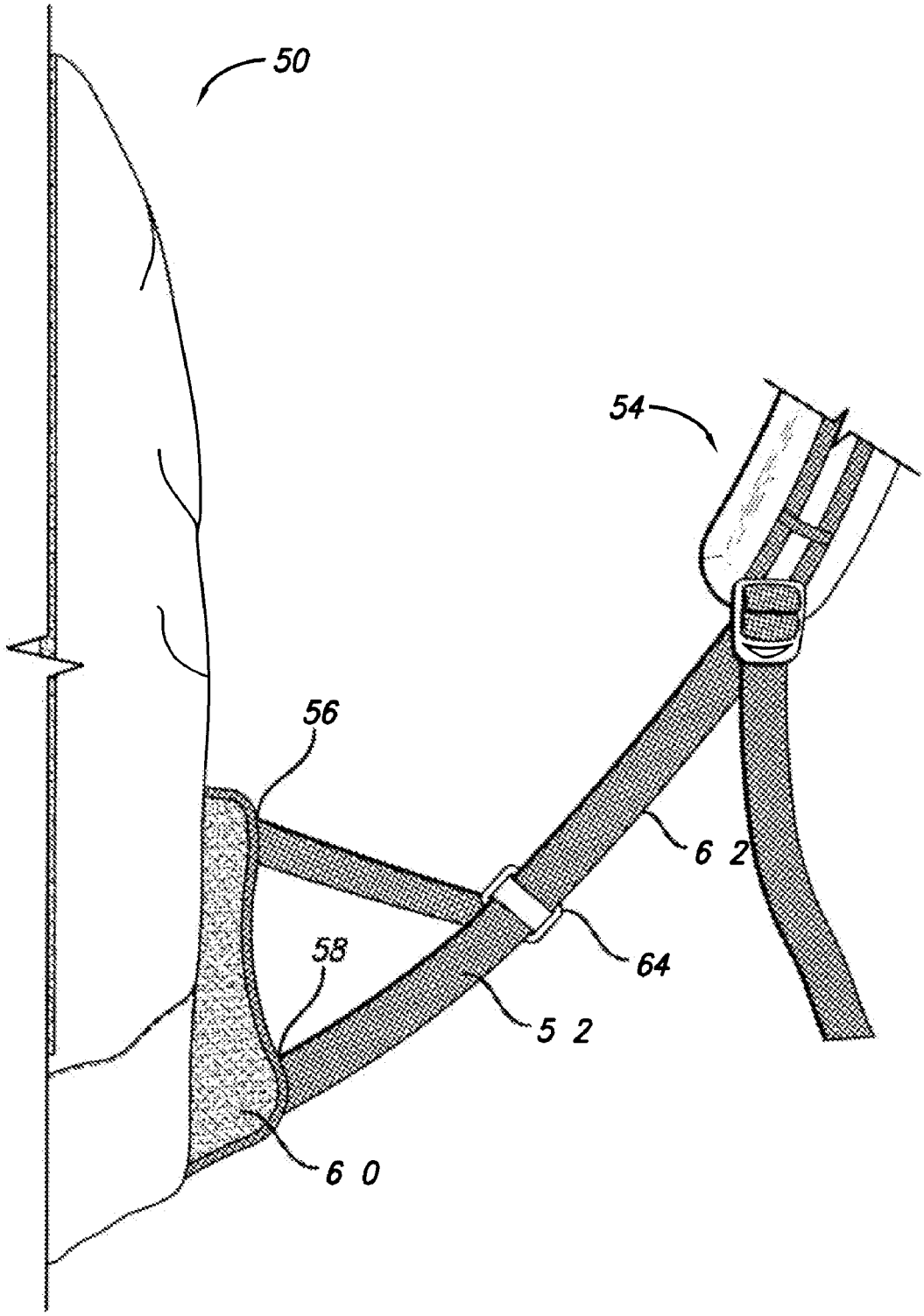
FIG. 3 is an elevational view of a side portion, similar to FIG. 2, of a second embodiment of a backpack in accordance with the invention, depicting the slide ring threaded by fixing strap having first and second end secured to a panel.

With reference now to FIG. 3, features of a second embodiment of a backpack 50 in accordance with the invention are depicted. In this embodiment, the backpack includes a fixing strap 52 for each shoulder strap 54 having both ends 56, 58 affixed to a corresponding panel 60. The ends of the fixing strap are attached to upper and lower portions of the panel, respectively. A lower webbing portion 62 of the shoulder strap is attached to the fixing strap via a ring 64. The ring is configured to slide along the fixing strap, providing a degree of self-adjustment to further facilitate comfort and load transfer.

Figure 4:
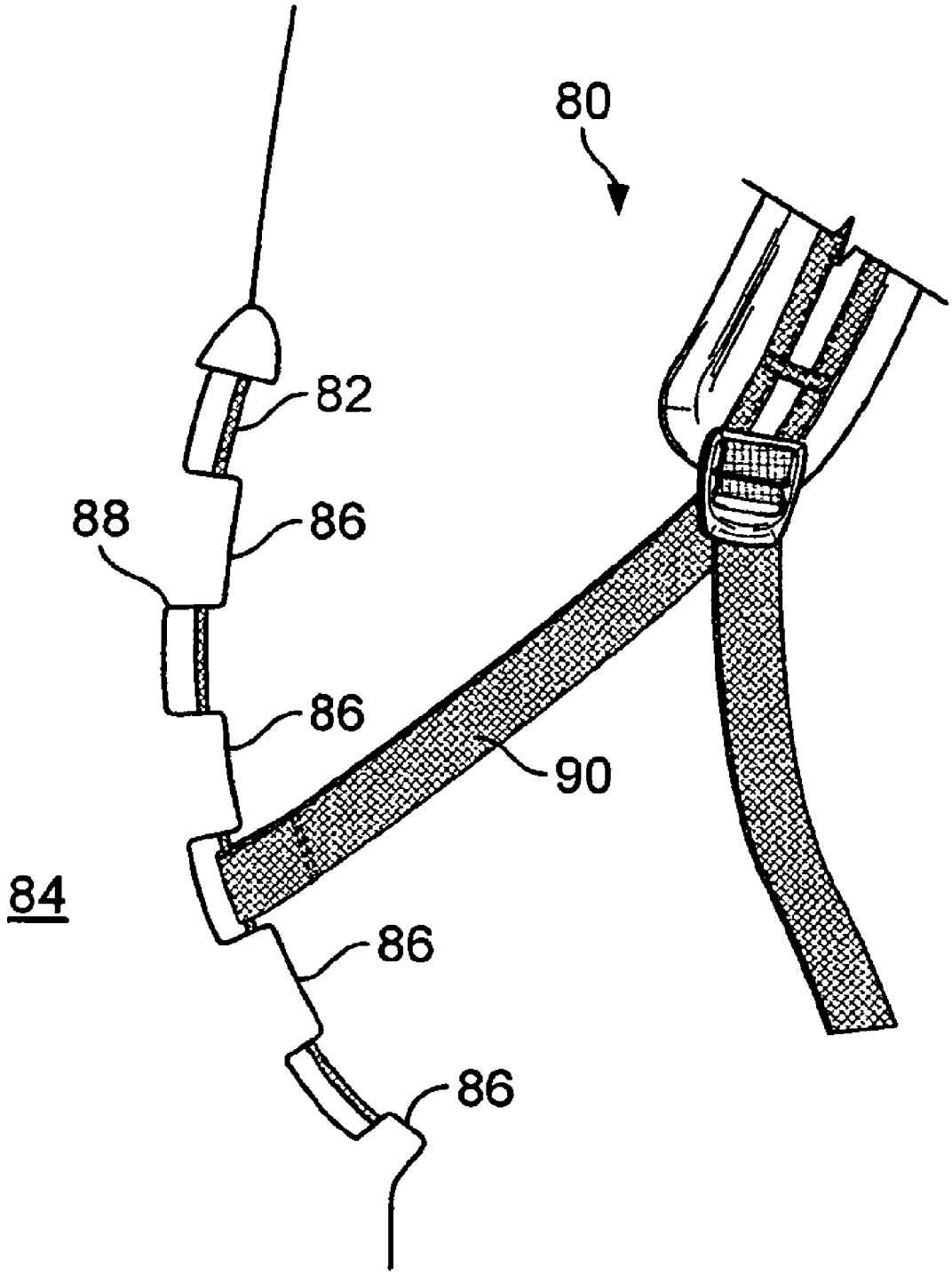
FIG. 4 is an elevational view of a side portion, similar to FIG. 2, of a third embodiment of a backpack in accordance with the invention, depicting a stiffening wand secured along a side portion of a pack body and a lower strap portion attached to the wand.

With reference now to FIG. 4, a side portion of a third embodiment of a backpack 80 in accordance with the invention is depicted. The backpack includes a pair of stiffening wands 82 secured along corresponding side portions 84 of a pack body. The wands are held in place via loops 86 of webbing secured to seam 88. The wand slides through the webbing and can be removed. The strap system includes a lower strap portion 90 attached to the wand. When worn, the lower straps distribute the load along the length of the wand, thereby transferring the load to lumbar region of the pack.

Figure 5:
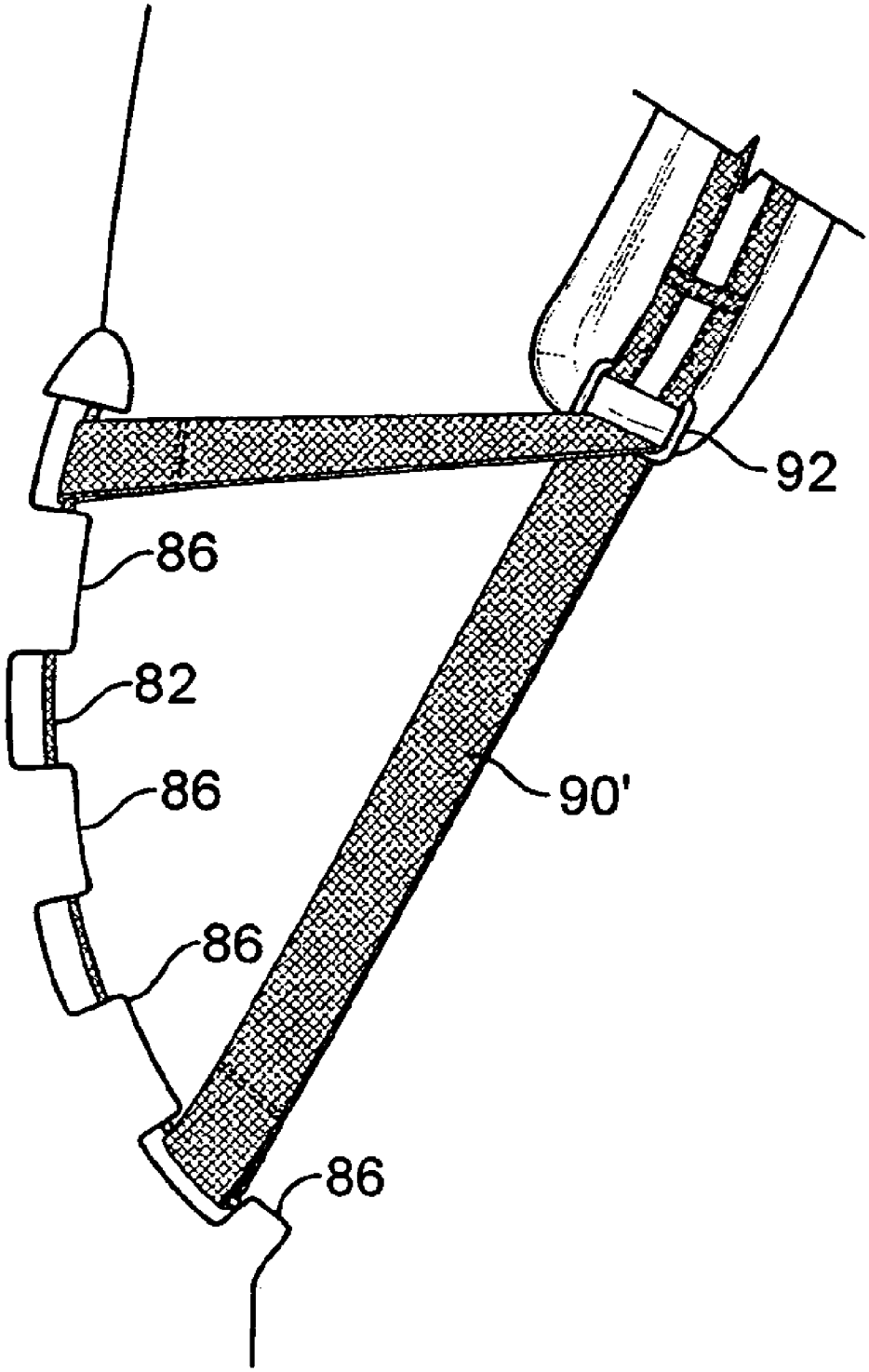
FIG. 5 is an elevational view of a side portion, similar to FIG. 2, of a fourth embodiment of a backpack in accordance with the invention, depicting a stiffening wand secured along a side portion of a pack body and a fixing strap having both ends attached to the wand at spaced locations.

As seen in FIG. 5, a fixing strap 90' can extend between an intermediate portion 92 of the shoulder strap and the wand, having both ends attached to the wand at spaced locations, thereby further facilitating effective load distribution about the lumbar region.

Figure 6:
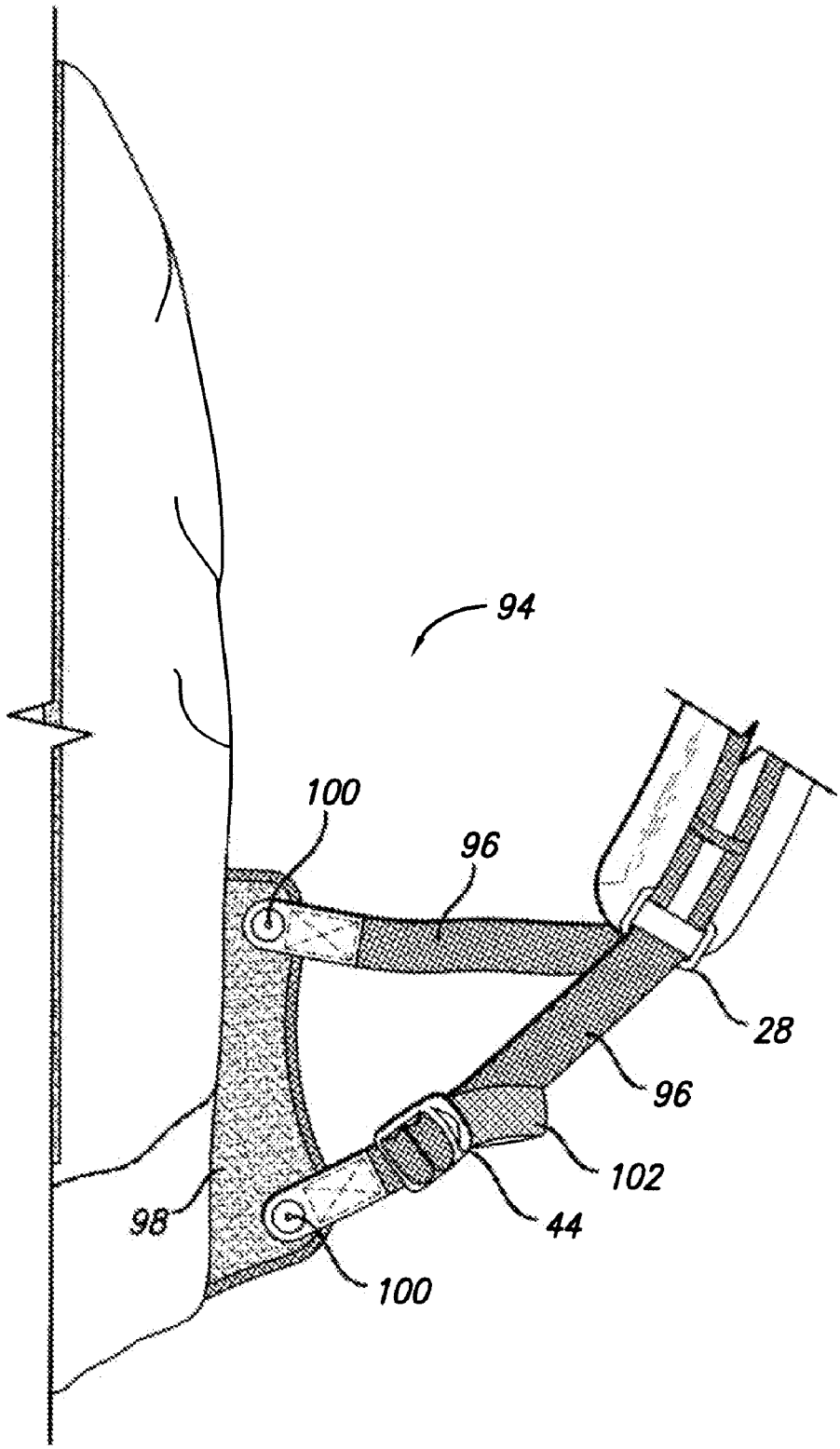
FIG. 6 is an elevational view of a side portion, similar to FIG. 2, of a fifth embodiment of a backpack in accordance with the invention, depicting a fixing strap having both ends pivotally attached at spaced locations.

With reference now to FIG. 6, a side portion of a fifth embodiment of a backpack 94 in accordance with the invention is depicted. The backpack 94 includes a fixing strap 96 attached a panel 98 by pivots 100. A ladder lock 44 is attached to the lower portion of the panel, and the second end 102 of the fixing strap is secured through the ladder lock. The fixing strap extends through a D-ring 28 on a padded portion of the shoulder strap, similar to the first embodiment depicted in FIG. 1. The fixing strap is allowed to slide about the D-ring, enabling the shoulder strap system to accommodate the user's body even during high activity.

It should be appreciated from the foregoing that the present invention resides in a backpack having a pack body and a shoulder strap system configured to hold the pack body securely against the user even during periods of high activity. The strap system includes two shoulder straps each having a lower portion attached to a coupler having an extended interface with the pack body, to inhibit sagging and secure the pack body to the user.

The present invention has been described above in terms of exemplary embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive. Accordingly, the invention is defined only by the claims set forth below.

What is claimed is:

1. A backpack, comprising:

a pack body configured to be disposed on a user's back, the pack body having an upper region and a lower region and further having a first side adjacent to the user's back, when the backpack is worn; and a shoulder strap system including a pair of shoulder straps configured to extend over both shoulders of the user, the strap system further including two couplers, each coupler attached to a lower portion of a corresponding shoulder strap and having an extended interface with the pack body, to inhibit sagging and secure the pack body to the user wherein each coupler includes a panel having a first edge attached to the pack body;

wherein each shoulder strap includes:

a padded portion extending over a respective shoulder of the user, a fixing strap having both ends coupled at spaced locations to the corresponding panel, a ring configured to slide along the fixing strap, and a lower webbing portion extending between the padded portion and the ring.

2. A backpack as defined in claim 1, wherein the pack body includes an internal frame.

3. A backpack as defined in claim 1, wherein the pack body excludes a frame.

4. A backpack as defined in claim 1, wherein each panel includes a stiffener formed of rigid material.

5. A backpack as defined in claim 1, wherein each coupler includes a stiffening wand secured to the pack body, and the shoulder strap system includes a lower strap portion for each shoulder strap attached to the corresponding wand.

6. A backpack, comprising:

a pack body configured to be disposed on a user's back, the sack having an upper portion and a lower portion and further having a first side adjacent to the user's back, when the backpack is worn;

a pair of couplers, each including a panel having first edge attached to the pack body to provide an extended interface with the pack body; and a pair of shoulder straps, each having an upper end coupled to the upper portion of the pack body, a padded portion, and a fixing strap disposed between the padded portion and the corresponding coupler;

wherein each fixing strap is pivotally attached to the corresponding panel at two spaced locations.

7. A backpack as defined in claim 6, wherein the pack body excludes a frame.

8. A backpack as defined in claim 6, further comprising a loop disposed about each fixing strap for coupling the padded portion of the shoulder strap to the fixing strap.

9. A backpack as defined in claim 8, further comprising a webbing strap extending between each loop and the corresponding padded portion.

10. A backpack, comprising:

a pack body configured to be disposed on a user's back, the sack having an upper portion and a lower portion and further having a first side adjacent to the user's back, when the backpack is worn;

a pair of couplers, each including a panel having first edge attached to the pack body to provide an extended interface with the pack body;

a pair of shoulder straps, each having an upper end coupled to the upper portion of the pack body, a padded portion, and a fixing strap disposed between the padded portion and the corresponding coupler; and a loop disposed about each fixing strap for coupling the padded portion of the shoulder strap to the fixing strap;

wherein a first end of each fixing strap is permanently affixed to the panel and a second end is adjustably attached to the panel.

* * * * *